United States Patent [19]

Galumbeck

[11] Patent Number: 4,872,227

[45] Date of Patent: Oct. 10, 1989

[54] STIFFENING MODULE FOR A MATTRESS BOX SPRING AND A BOX SPRING INCORPORATING SAME

[76] Inventor: Michael H. Galumbeck, 5577 Vantage Point Rd., Columbia, Md. 21044

[21] Appl. No.: 141,081

[22] Filed: Jan. 5, 1988

[51] Int. Cl.[4] ..... A47C 23/057

[52] U.S. Cl. ..... 5/246; 5/259 R; 5/255; 5/464; 267/86

[58] Field of Search ..... 267/86, 93, 95, 103; 5/259 R, 259 B, 255, 247, 246, 464, 439

[56] References Cited

U.S. PATENT DOCUMENTS

| | | | |
|---|---|---|---|
| 88,602 | 4/1869 | Barnum | 5/259 |
| 130,788 | 8/1872 | Brooks | 5/255 X |
| 182,745 | 10/1876 | Bronson | 5/259 B X |
| 767,375 | 8/1904 | Bigelow | 5/259 B X |
| 771,191 | 9/1904 | Venable | 5/247 |
| 871,244 | 11/1907 | Smith et al. | 5/259 B |
| 888,276 | 5/1908 | Venable | 5/247 |
| 2,249,031 | 7/1941 | Neely | 5/259 B X |
| 2,267,472 | 12/1941 | Lieberman | 267/103 X |
| 2,526,250 | 10/1950 | Matthaei, Jr. | 5/255 X |
| 2,578,331 | 12/1951 | White . | |
| 3,673,619 | 7/1972 | Kline | 5/255 X |
| 4,012,801 | 3/1977 | King et al. | 5/247 |
| 4,057,860 | 11/1977 | Higgins et al. | 5/247 |
| 4,129,908 | 12/1978 | Wagner . | |
| 4,161,046 | 7/1979 | Golembeck | 5/464 X |
| 4,684,111 | 8/1987 | Hagemeister . | |

FOREIGN PATENT DOCUMENTS

| | | | |
|---|---|---|---|
| 1102557 | 10/1955 | France | 5/246 |
| 639746 | 5/1962 | Italy | 5/247 |
| 726456 | 3/1955 | United Kingdom | 5/246 |
| 827221 | 2/1960 | United Kingdom | 267/95 |

*Primary Examiner*—Gary L. Smith
*Assistant Examiner*—Eric K. Nicholson
*Attorney, Agent, or Firm*—Sixbey, Friedman, Leedom & Ferguson

[57] ABSTRACT

A spring module for a mattress box spring is formed of a stiffening element made of a sinuously-shaped spring wire and an attachment clip for attaching the spring module to a frame of a box spring, the length of wire being resiliently bent into a circular form and held in the circular form by opposite end portions of the length of wire being engaged with the attachement spring clip. In accordance with the preferred embodiment, the attachment clip is formed of a plate having a pair of notches at opposite lateral sides thereof that receive a respective end portion of each of opposite ends of the circularly bent length of wire with the plate passing through terminal undulations of the sinuous shape located at these opposite end portions. Furthermore, for enabling the plate to grasp respective wires of a wire frame of a mattress box spring, each of opposite longitudinal ends of the plate is provided with a central offset tongue. A box spring incorporating the spring module utilizes at least one spring module in conjunction with a multiplicity of coil springs of a lesser stiffness, the coil springs and the modules extending between upper and lower frames of the box spring.

19 Claims, 2 Drawing Sheets

STIFFENING MODULE FOR A MATTRESS BOX SPRING AND A BOX SPRING INCORPORATING SAME

BACKGROUND OF THE INVENTION

1. Field of the Invention

The present invention relates to bedsprings, especially box springs for mattresses and spring modules for use in such box springs. More specifically, the present invention relates to the spring module which may be attached to a box spring frame at various locations in order to locally vary the stiffness or firmness of the box spring at that location.

2. Description of Related Art

Typically, a box spring for a mattress comprises upper and lower frames which are interconnected by helically or spirally coiled springs that are spaced over the full area of the box spring. This whole assembly is enclosed in a fabric or foam and fabric covering and is used to support a mattress upon a bed frame.

In addition to the typically used coil springs, other forms of bed springs are known. For example, in U.S. Pat. No, 2,578,331 of Calvin F. White, a bedspring is disclosed wherein the top and bottom frames are interconnected by a multiplicity of C-shaped semicircular elements formed of sinusoidal wire. The resilient elements are arranged in parallel rows with the concave faces of adjacent rows oriented in opposite directions and with the spring elements on one side of the longitudinal center line of the assembly oriented oppositely to those on the opposite side of the longitudinal center line of the assembly.

Another substitute for the typical spirally or helically coiled springs used in box springs for mattresses is the bent wire spring module of the Hagemeister Pat. No. 4,684,111. The spring module of this patent, in front view, has a rectangular appearance with elongated vertical sides interconnected by shorter top and bottom sides. The top and bottom sides are attaching elements comprised of spaced parallel links of wire joined by diagonals and are connected to the respective top and bottom frames by staples or clips. The vertically oriented parallel sidewalls, when viewed in side elevation, are comprised of first, transversely-spaced, parallel, oppositely-inclined, upwardly-extending legs; second transversely-spaced, parallel, oppositely-inclined, downwardly-extending legs; third transversely-spaced, parallel, oppositely-inclined legs that are inclined in an opposite direction from the first and second legs, and fourth legs interconnecting the first legs to the third legs and the second legs to the third legs. The first, second and third legs are of substantially the same length and the fourth legs are disposed in spaced, parallel relation, and are substantially vertical so that the overall appearance is of a single positive and negative phase of a trapezoidally-shaped wave form. This spring module is designed to yield by bending of the legs relative to each other.

It also known how to variously construct springs for use in a box spring so as to provide for softer or stiffer (firmer) yielding characteristics. However, whether softer or stiffer springs have been used, the practice has been to utilize in any given box spring, springs of a uniform firmness so as to produce a softer or firmer support for a mattress that is uniform across the area thereof. On the other hand, it is desirable to be able to selectively produce a localized stiffening of the support for a mattress at various locations, which locations may differ, depending upon the use of the particular box spring. However, a spring module which is optimally usable for producing such a localized stiffening of a mattress box spring, from the standpoints of ease of manufacture and assembly and cost, has heretofore been unknown, and single strand heavy wire stiffeners as have been used extending parallel to the coil springs have suffered several drawbacks. Since these heavy wire stiffeners are made for much heavier wire than the conventional mattress coil springs, they are difficult to attach to the mattress frame in a manner which will assure lateral stability. They also have substantially no resiliency and therefore are prone to break when subjected to impact or heavy loads. Thus, the need exists for such a spring stiffening module that may be selectively and easily inserted between the coil springs of otherwise conventional mattress box spring assemblies which has both lateral stability as well as resiliency.

SUMMARY OF THE INVENTION

It is a primary object of the present invention to provide a durable spring module that can be easily and economically manufactured and installed in a box spring for a mattress to provide stiffening support at selected locations.

It is a further object of the present invention to provide a box spring for a mattress incorporating a spring module which is used, in addition to a multiplicity of conventional coil springs, to provide areas of localized increased stiffness.

It is a particular object in accordance with the present invention to provide a spring module wherein an attachment clip is used to both secure opposed ends of a sinuous spring wire into a circular shape to provide lateral stability and to removably attached the spring wire to a box spring frame, especially a wire frame, without the use of other clips or attachment units.

These and other objects are achieved, in accordance with a preferred embodiment of the present invention, by a spring module that comprises a stiffening element made of a sinuously-shaped length of spring wire and an attachment means for attaching the spring module to a frame of a box spring. The length of wire is resiliently bent into a circular form and held in this circular form by opposite end portions of the length of wire being engaged by the attachment means. Advantageously, the attachment means is an attachment clip for engaging a wire frame and, in accordance with the preferred embodiment, is in the form of an elongated rectangular plate. The plate is provided with a pair of notches at opposite lateral edges thereof for receiving a respective end portion of the length of wire and passes through a terminal undulation of the sinuous shape that is located at each of the opposite end portions. Furthermore, the plate has a central offset tongue at each of opposite longitudinal ends thereof for grasping a respective wire of a wire frame, and in use, the clip is locked in place by the spring action of the length of sinuous wire.

A box spring for a mattress, in accordance with the present invention, utilizes at least one of the noted stiffening spring modules. Each module extends between upper and lower frames of the box spring at a location where greater support is desired than that produced by the multiplicity of coil springs of a given stiffness that are spaced over the area of the frames and which also extend between the upper and lower frames.

These and other features, objects and advantages of the present invention will become more apparent from the following description and accompanying drawings which, for purposes of illustration only, describe a single embodiment in accordance with the present invention.

DETAILED DESCRIPTION OF THE PREFERRED EMBODIMENT

Figure 1:
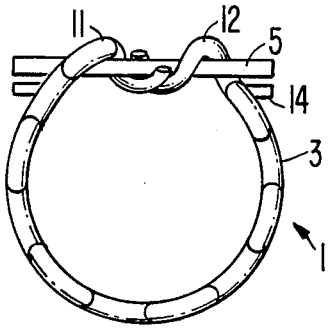
FIG. 1 is a side elevational view of a preferred embodiment spring module in accordance with the present invention.
Figure 2:
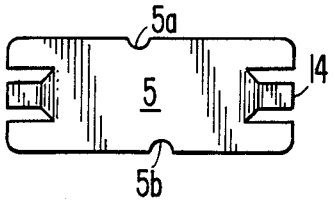
FIG. 2 is a top plan view of a plate-like attachment clip forming part of the spring module of FIG. 1.
Figure 3:
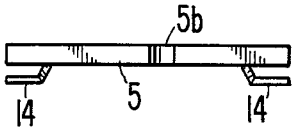
FIG. 3 is a side elevational view of the attachment clip shown in FIG. 2.
Figure 4:
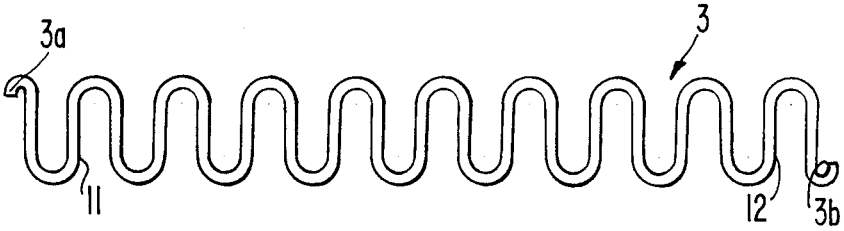
FIG. 4 is a top view of a sinuously-shaped length of spring wire forming part of the spring module of FIG. 1.

As can be seen with reference to FIGS. 1–4, the stiffening spring module for a mattress box spring, in accordance with the present invention, is designated generally by the reference numeral 1 and is comprised of a stiffening element made of a sinuously-shaped length of spring wire 3 and an attachment means, in the form of an attachment clip plate 5. Attachment clip plate 5 is used for attaching the spring module 1 to a frame 7 (FIGS. 5–7) of a box spring 9. The sinuous shape of the spring wire is most clearly seen in FIG. 4 and is retained despite the bending of the wire into a circular form. The spring wire 3 is held in the illustrated circular form by its oppositely curved or hooked end portions *3a, 3b* being engaged with the attachment clip plate 5.

For purposes of engaging the attachment clip plate 5 with the end portions *3a, 3b* of the spring wire 3, the attachment clip plate 5 is provided with a pair of notches *5a, 5b* which each receive one of the hooked end portions *3a, 3b*, respectively. To secure the spring wire 3 to the attachment plate 5, the plate 5 is passed through terminal undulations 11, 12, which are located at each of the respective ends of the spring wire 3 and of which the end portions *3a, 3b* form a terminal leg. In this way, the end portions forming the terminal legs of the undulations 11, 12 are disposed on one side of the plate 5 and the other leg of the undulations 11, 12 are disposed on the opposite side of the attachment clip plate 5, thereby further acting to hold the attachment clip plate 5 in place relative to the wire 3, in conjunction with the engagement of the end portions *3a, 3b* in the notches *5a, 5b*. The manner in which the plate 5 passes through the undulations 11, 12 can be clearly appreciated when FIG. 1 is viewed in conjunction with FIGS. 5 and 6.

For purposes of attaching the module 1 to a wire box spring frame, such as frame 7, a central offset tongue is formed at each of the opposite longitudinal ends of the attachment clip plate 5, these tongues bearing the reference numeral 14 in the drawings. As can be seen from FIG. 5, a respective box spring cross wire 16 fits between the tongue 14 and the remainder of the end of the clip plate 5 from which the tongue has been separated. Furthermore, when a frame 7 as shown in FIG. 5 is utilized, by having spaced clipped cross wires 16 disposed at opposite ends of the plate 5 and another cross wire 17 (situated between the pair of cross wires 16), passing across the top of the clip plate 5, it can be assured that the plate 5 will be held tightly in place against accidental disengagement.

Figure 5:
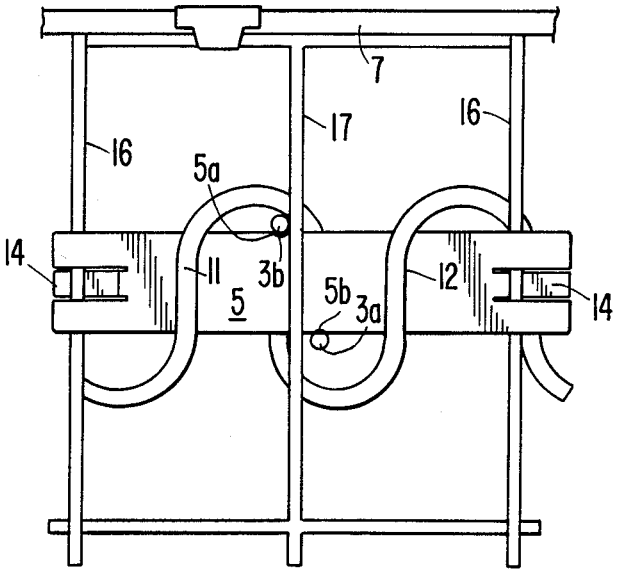
FIG. 5 is a top plan view illustrating a portion of the spring module of FIG. 1 attached by the attachment clip to the wire grid of a box spring.
Figure 6:
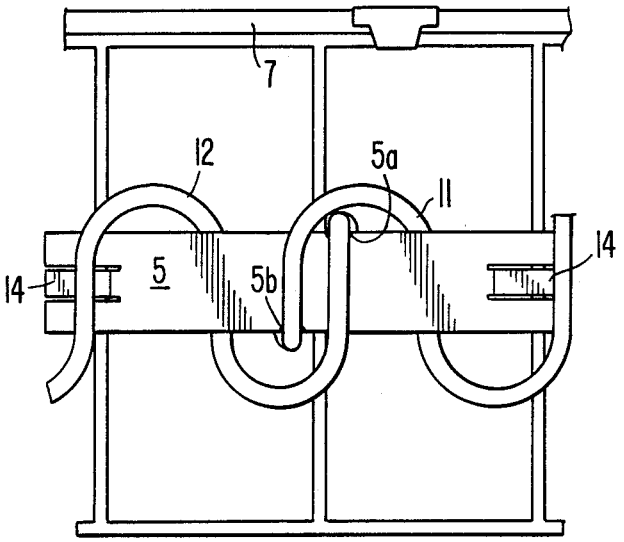
FIG. 6 is a bottom plan view showing the spring module and attachment clip of FIG. 5.

Referring to the top plan view of FIG. 5 and the bottom plan view of FIG. 6, it will be noted that the S-shaped undulation 11 passes under a cross wire 16 and over the plate 5 and then under the cross wire 17 and the plate 5 so that the hooked end *3a* snaps into the notch *5a*. The undulation 11 passes under the cross wire 16 and over the plate 5 from the lower side of the plate, while the S-shaped undulation 12 begins from the upper side of the opposite end of the plate and passes under a cross wire 16, over the plate, under the cross wire 17 and then under the plate so that the hooked end 36 is snapped into the notch *5a*, thus the spring tension of the wire 3 combined with the tension of the cross wires 16 and 17 securely holds the plate 5 in place and locks the wire 3 to the plate.

The spring modules 1 can be attached at various locations and, if found to produce an undesirable result, can be removed or repositioned until the desired result is achieved, prior to enclosing the box spring unit 9 within the desired covering material.

Figure 7:
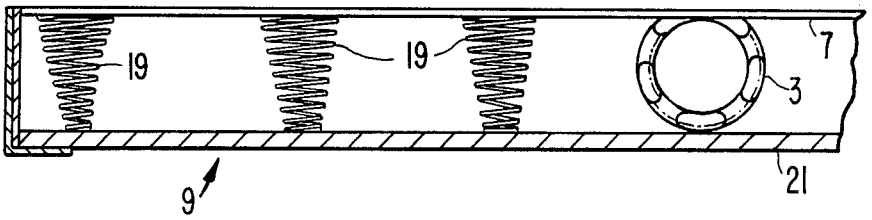
FIG. 7 is a side view of a portion of a box spring illustrating the manner in which the spring module and coil springs extend between upper and lower frames thereof.

As can be seen from FIGS. 5–7, the box spring 9 is comprised of upper and lower frames 7 and 21, respectively, between which a multiplicity of conventional coil springs 19 extend at various locations that are spaced over the area of the frames. Furthermore, at locations where additional stiffness is required, the otherwise conventional box spring 9 can be modified by either the replacement of a coil spring 19 with a spring module 1 or the addition of a spring module 1 wherein the length of spring wire 3 is formed of heavy wire of greater stiffness than that of the coil springs 19. For example, it may be desired to provide stiffening at various portions of the periphery, such as the location shown in FIG. 7, where someone might be expected to sit at the edge of the bed and thereby apply of greater load than experienced at other portions of the bed. Likewise, it might be desired to provide increased support in the region where it could be reasonably expected that a person's lower back area would be situated in a normal sleeping position. Because of the ease with which the modules 1 can be attached, the assembly process can be carried out quickly and efficiently while affording a reasonable ability to customize the characteristics of the box spring.

While it will be recognized that the construction of the spring wire 3 and attachment means 5 will be a function of the size of the box spring and the desired stiffness characteristics to be produced, the following characteristics have been found suitable for use in at least one case. In particular, a piece of 4 millimeter diameter spring steel wire of a length sufficient to produce a sinuous shape having peaks and legs of a peak-to-peak amplitude of 2 inches and approximately a $2\frac{1}{2}$ inch span between successive, commonly directed, peaks was bent into a 6 inch diameter circle and retained, as shown in FIG. 1, by an attachment clip plate $4\frac{3}{4}$ inches long, 1 inch wide, and $\frac{1}{8}$ inch thick. Furthermore, such a module construction was found easy and economical to both produce and install, and was also found to be durable in use, i.e., was not prone to breakage. This is due to the fact that the circular configuration of the spring wire 3 held in the manner shown by the clip 5 is resilient.

By forming the stiff, sinuously-shaped spring wire unit 3 into a circular configuration and attaching it to the frame 7 by the plate 5 which spans three cross wires, the spring wire is laterally stable in all directions. It contacts the bottom frame 21 over an extended area to provide an enhanced support.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A stiffening spring module for a spring unit having a wire frame which includes a plurality of spaced wire grid members comprising stiffening means having a spring formed by a sinuously-shaped length of spring wire terminating at opposite ends in first and second substantially "S" shaped end sections respectively, each said end section including a terminal leg having a free end, an intermediate leg spaced from said terminal leg and an inner leg spaced from said intermediate leg, said intermediate leg being joined to said terminal and inner legs to form undulations having two adjacent loops with a first loop between said intermediate and terminal legs and a second loop between said intermediate and inner legs, and attachment means for attaching the stiffening means to said wire frame and being locked into engagement with said stiffening means by a spring action of the spring thereof, said attachment means including an elongate member having first and second ends which is dimensioned to extend through at least the first loops of said first and second end sections, said elongate member having engagement means formed intermediate the first and second ends thereof to engage the terminal legs of said first and second end sections to form a loop from said length of spring wire, the spring action of said stiffening means operating to hold said terminal legs in engagement with said engagement means.

2. The stiffening spring module of claim 1, wherein said elongate member includes first and second opposed surfaces, said engagement means being formed to receive and lock into engagement with said terminal legs when said terminal legs both extend in contact with said first surface and said intermediate legs extend in contact with said second surface.

3. The stiffening spring module of claim 2, wherein said engagement means includes a first locking means for engaging the terminal leg of said first "S" shaped end section and a second locking means spaced from said first locking means for engaging the terminal leg of said second "S" shaped end section.

4. The stiffening spring module of claim 2, wherein said inner legs of said first and second "S" shaped end sections extend adjacent to said first surface of said elongate member.

5. The stiffening spring module of claim 4, wherein the loop formed from said length of spring wire extends outwardly from the first surface of said elongate member.

6. The stiffening spring module of claim 5, wherein said elongate member is dimensioned to extend outwardly beyond said inner legs of said first and second "S" shaped end sections when said terminal legs are locked in engagement with said engagement means.

7. The stiffening spring module of claim 3, wherein said elongate member is formed from a plate, said first and second locking means being provided by a pair of notches formed at opposite lateral edges of said plate.

8. The stiffening spring module according to claim 7, wherein said plate has a central offset tongue at each of opposite longitudinal ends of the plate for grasping a respective wire grid member of the wire frame.

9. The stiffening spring module according to claim 1, wherein said elongate member is formed of a plate, and wherein said plate has a central offset tongue at each of opposite longitudinal ends of the plate for grasping a respective wire grid member of the wire frame.

10. A spring unit comprising an upper frame and a lower frame spaced beneath said upper frame, one of said frames having a plurality of spaced wire grid members, a multiplicity of coil springs of a given stiffness extending between said upper and lower frames at various locations spaced over the area of said frames and at least one stiffening spring module of a greater stiffness than that of said coil springs extending between said upper and lower frames at a location where greater support is desired, said stiffening spring module including stiffening means having a spring formed by a sinuously-shaped length of spring wire formed into a loop, said spring wire having curved undulations forming side-by-side spring loops with each spring loop including first and second spaced side legs, and attachment means for attaching said stiffening means to said spaced wire grid members, said attachment means including an elongate member having first and second ends which are dimensioned to extend through and outwardly beyond at least a first end and a second end of said spring loops with each of said first and second ends extending over at least one of said spaced wire grid members at a point outwardly from said first and second spring loops respectively.

11. A spring unit according to claim 10, wherein said elongate member includes engagement means formed thereon intermediate the first and second ends to engage one side leg of each of said first and second spring loops.

12. A box spring according to claim 10, wherein said elongate member is formed of a plate, and wherein said plate has a central offset tongue at each of opposite first and second ends of the plate which grasps a respective wire grid member of the upper frame.

13. A spring unit according to claim 10, wherein said elongate member includes first and second opposed surfaces, the first side leg of said first and second spring loops engaging said first surface of said elongate member and the second side leg engaging said second surface.

14. A spring unit according to claim 13, wherein said first side legs of said first and second spring loops are centrally positioned relative to said elongate member and said second side legs of said first and second spring loops are positioned between the first side leg of the respective spring loop and a respective first or second end of said elongate member.

15. A spring unit according to claim 14, wherein said loop formed from said length of spring wire extends outwardly from the first surface of said elongate member and the first surface of said elongate member contacts and overlies the spaced wire grid members at the first and second ends of said elongate member.

16. A spring unit according to claim 15, wherein the first side leg of said first and second spring loops terminates at a free end, said elongate member including engagement means formed thereon intermediate the first and second ends to engage the first side leg of said first and second spring loops for attaching said stiffening means to said elongate member by the spring action of said stiffening means.

17. A spring unit according to claim 16, wherein said elongate member is formed from a plate, said engagement means being provided by a pair of notches formed at opposite lateral edges of said plate.

18. A spring unit according to claim 14, wherein the spring loops of said spring wire adjacent to and outboard of said first and second spring loops include a first side leg which constitutes the second side leg of an adjacent first or second spring loop and a second side leg, the second side leg of said adjacent spring loops underlying the first surface of said elongate member.

19. A box spring according to claim 17, wherein said plate has a central offset tongue at each of opposite first and second ends of the plate which grasps a respective wire grid member of the upper frame.

* * * * *